US011024232B2

(12) United States Patent
Gao et al.

(10) Patent No.: US 11,024,232 B2
(45) Date of Patent: Jun. 1, 2021

(54) PIXEL DRIVING CIRCUIT AND DRIVING METHOD THEREFOR, AND DISPLAY PANEL

(71) Applicant: BOE TECHNOLOGY GROUP CO., LTD., Beijing (CN)

(72) Inventors: Xueling Gao, Beijing (CN); Kuanjun Peng, Beijing (CN); Wei Qin, Beijing (CN); Zhiqiang Xu, Beijing (CN); Tieshi Wang, Beijing (CN); Xiaolong Li, Beijing (CN); Jintao Peng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/769,420

(22) PCT Filed: Nov. 11, 2019

(86) PCT No.: PCT/CN2019/117199
§ 371 (c)(1),
(2) Date: Jun. 3, 2020

(87) PCT Pub. No.: WO2020/103720
PCT Pub. Date: May 28, 2020

(65) Prior Publication Data

US 2020/0302867 A1 Sep. 24, 2020

(30) Foreign Application Priority Data

Nov. 22, 2018 (CN) ..... 201811396847.0

(51) Int. Cl.
*G09G 3/3258* (2016.01)
*G09G 3/3275* (2016.01)

(52) U.S. Cl.
CPC ..... *G09G 3/3258* (2013.01); *G09G 3/3275* (2013.01); *G09G 2300/043* (2013.01)

(58) Field of Classification Search
CPC .. G09G 3/3233; G09G 3/3266; G09G 3/3258; G09G 2300/043; G09G 2320/045;
(Continued)

(56) References Cited

U.S. PATENT DOCUMENTS 10,004,124 B1 6/2018 Ko et al.
2012/0235972 A1 9/2012 Liu et al.
(Continued)

FOREIGN PATENT DOCUMENTS

CN 102222465 A 10/2011
CN 104485071 A 4/2015
(Continued)

OTHER PUBLICATIONS

International Search Report of PCT/CN2019/117199 in Chinese, dated Feb. 1, 2020, with English translation.
(Continued)

*Primary Examiner* — Gerald Johnson
(74) *Attorney, Agent, or Firm* — Collard & Roe, P.C.

(57) ABSTRACT

A pixel driving circuit and a driving method thereof, and a display panel are provided. The pixel driving circuit includes a driving sub-circuit, a reset sub-circuit, a light-emitting control sub-circuit, and a first compensation sub-circuit, the reset sub-circuit, the light-emitting control sub-circuit, and the first compensation sub-circuit are configured to, in an initialization phase, under control of a first driving signal and a second driving signal, provide the first power supply voltage provided by the first power supply input terminal to the control terminal of the driving sub-circuit; the first terminal of the driving sub-circuit is connected to the second power supply input terminal to receive the second power
(Continued)

supply voltage; and the first power supply voltage and the second power supply voltage are configured to cause the driving sub-circuit to be in an on-bias state in the initialization phase.

17 Claims, 6 Drawing Sheets

(58) Field of Classification Search
CPC ... G09G 2310/0267; G09G 2320/0242; G09G 2310/0278; G09G 3/3208
See application file for complete search history.

(56) References Cited

U.S. PATENT DOCUMENTS

| | | | | |
|---|---|---|---|---|
| 2013/0314305 | A1* | 11/2013 | Liu | G09G 3/32 345/77 |
| 2014/0111563 | A1 | 4/2014 | Hwang et al. | |
| 2016/0133191 | A1 | 5/2016 | Kang et al. | |
| 2018/0130411 | A1* | 5/2018 | Zhou | G09G 3/3225 |
| 2018/0130420 | A1* | 5/2018 | Gao | H01L 51/5206 |
| 2019/0189054 | A1 | 6/2019 | Yang et al. | |
| 2020/0302867 | A1 | 9/2020 | Gao et al. | |

FOREIGN PATENT DOCUMENTS

| | | | |
|---|---|---|---|
| CN | 105761664 | A | 7/2016 |
| CN | 106652915 | A | 5/2017 |
| CN | 107863069 | A | 3/2018 |
| CN | 108510936 | A | 9/2018 |
| CN | 109243370 | A | 1/2019 |

OTHER PUBLICATIONS

Written Opinion of the International Searching Authority of PCT/CN2019/117199 in Chinese, dated Feb. 1, 2020.
Chinese Office Action in Chinese Application No. 201811396847.0, dated Dec. 16, 2019 with English translation.

* cited by examiner

PIXEL DRIVING CIRCUIT AND DRIVING METHOD THEREFOR, AND DISPLAY PANEL

CROSS REFERENCE TO RELATED APPLICATIONS

This application is the National Stage of PCT/CN2019/117199 filed on Nov. 11, 2019, which claims priority under 35 U.S.C. § 119 of Chinese Application No. 201811396847.0 filed on Nov. 22, 2018, the disclosure of which is incorporated by reference.

TECHNICAL FIELD

Embodiments of the present disclosure relate to a pixel driving circuit and a driving method thereof, and a display panel.

BACKGROUND

Due to a hysteresis effect of a driving transistor in a pixel circuit, in a case where an existing organic light-emitting diode (OLED) product switches to a 48-grayscale picture after lighting a black-and-white picture for a period of time, an afterimage will be generated, and after a period of time, the afterimage will disappear, so that the correct 48-grayscale picture is displayed, this phenomenon is a short-term afterimage, as shown in FIG. 1. For example, a 14 inch OLED product of relevant manufacturers, after displaying the black-and-white picture for 10 seconds (s), switches to displaying the 48-grayscale picture. At this time, the short-term afterimage will disappear after 2 seconds. For another example, the Galaxy S6 of the relevant manufacturers, after displaying the black-and-white picture for 10 s, switches to displaying the 48-grayscale picture, and the short-term afterimage will disappear after 6 s.

Therefore, how to ameliorate the short-term afterimage caused by the hysteresis effect is an urgent problem to be solved for OLED products.

SUMMARY

At least one embodiment of the present disclosure provides a pixel driving circuit, and the pixel driving circuit includes a driving sub-circuit, a light-emitting element, a reset sub-circuit, a light-emitting control sub-circuit, and a first compensation sub-circuit; the reset sub-circuit is connected to a first power supply input terminal, a first driving signal terminal, the light-emitting control sub-circuit, and a first electrode of the light-emitting element; the light-emitting control sub-circuit is also connected to a second driving signal terminal, a second terminal of the driving sub-circuit, and the first electrode of the light-emitting element; the first compensation sub-circuit is connected to the first driving signal terminal, the second terminal of the driving sub-circuit, and a control terminal of the driving sub-circuit; the reset sub-circuit, the light-emitting control sub-circuit, and the first compensation sub-circuit are configured to, in an initialization phase, under control of a first driving signal provided by the first driving signal terminal and a second driving signal provided by the second driving signal terminal, provide a first power supply voltage provided by the first power supply input terminal to the control terminal of the driving sub-circuit; a first terminal of the driving sub-circuit is connected to a second power supply input terminal to receive a second power supply voltage; and the first power supply voltage and the second power supply voltage are configured to cause the driving sub-circuit to be in an on-bias state in the initialization phase.

For example, the pixel driving circuit provided by an embodiment of the present disclosure further includes a data writing sub-circuit and a storage sub-circuit; the data writing sub-circuit is connected to a third driving signal terminal, a data signal terminal, and a first terminal of the storage sub-circuit, respectively, and is configured to, in the initialization phase, under control of a third driving signal provided by the third driving signal terminal, write a data voltage provided by the data signal terminal to the first terminal of the storage sub-circuit; and a second terminal of the storage sub-circuit is connected to the control terminal of the driving sub-circuit, and the storage sub-circuit is configured to store the data voltage.

For example, the pixel driving circuit provided by an embodiment of the present disclosure further includes a second compensation sub-circuit; the second compensation sub-circuit is connected to the third driving signal terminal, the first terminal of the storage sub-circuit, and the second power supply input terminal, respectively, and is configured to, in a compensation phase, under control of the third driving signal, provide the second power supply voltage to the first terminal of the storage sub-circuit.

For example, in the pixel driving circuit provided by an embodiment of the present disclosure, the reset sub-circuit is further configured to, in the initialization phase, under control of the first driving signal, provide the first power supply voltage to the first electrode of the light-emitting element to reset the first electrode of the light-emitting element.

For example, in the pixel driving circuit provided by an embodiment of the present disclosure, the driving sub-circuit comprises a first transistor, the control terminal of the driving sub-circuit is a gate electrode of the first transistor, the first terminal of the driving sub-circuit is a first electrode of the first transistor, and the second terminal of the driving sub-circuit is a second electrode of the first transistor.

For example, in the pixel driving circuit provided by an embodiment of the present disclosure, the reset sub-circuit comprises a second transistor, a gate electrode of the second transistor is connected to the first driving signal terminal, a first electrode of the second transistor is connected to the first power supply input terminal, and a second electrode of the second transistor is connected to the first electrode of the light-emitting element; the first compensation sub-circuit comprises a third transistor, a gate electrode of the third transistor is connected to the first driving signal terminal, a first electrode of the third transistor is connected to the gate electrode of the first transistor, and a second electrode of the third transistor is connected to the second electrode of the first transistor; and the light-emitting control sub-circuit comprises a fourth transistor, a gate electrode of the fourth transistor is connected to the second driving signal terminal, a first electrode of the fourth transistor is connected to the second electrode of the first transistor, and a second electrode of the fourth transistor is connected to the first electrode of the light-emitting element.

For example, in the pixel driving circuit provided by an embodiment of the present disclosure, an electrical characteristic of the first transistor, an electrical characteristic of the second transistor, an electrical characteristic of the third transistor, and an electrical characteristic of the fourth transistor are all identical.

For example, in the pixel driving circuit provided by an embodiment of the present disclosure, the first transistor, the second transistor, the third transistor, and the fourth transistor are P-type thin film transistors.

For example, in the pixel driving circuit provided by an embodiment of the present disclosure, the storage sub-circuit comprises a capacitor, the first terminal of the storage sub-circuit comprises a first electrode of the capacitor, the second terminal of the storage sub-circuit comprises a second electrode of the capacitor, and the first electrode of the capacitor is connected to the gate electrode of the first transistor; the data writing sub-circuit comprises a fifth transistor, a gate electrode of the fifth transistor is connected to the third driving signal terminal, a first electrode of the fifth transistor is connected to the data signal terminal, and a second electrode of the fifth transistor is connected to the second electrode of the capacitor; and the second compensation sub-circuit comprises a sixth transistor, a gate electrode of the sixth transistor is connected to the third driving signal terminal, a first electrode of the sixth transistor is connected to the second electrode of the fifth transistor, and a second electrode of the sixth transistor is connected to the first electrode of the first transistor.

For example, in the pixel driving circuit provided by an embodiment of the present disclosure, an electrical characteristic of the first transistor is identical to an electrical characteristic of the fifth transistor, and the electrical characteristic of the first transistor is opposite to an electrical characteristic of the sixth transistor.

For example, in the pixel driving circuit provided by an embodiment of the present disclosure, the fifth transistor is a P-type thin film transistor, and the sixth transistor is an N-type thin film transistor.

For example, in the pixel driving circuit provided by an embodiment of the present disclosure, the first driving signal terminal and the third driving signal terminal are a same signal terminal, and the first driving signal is identical to the third driving signal.

For example, in the pixel driving circuit provided by an embodiment of the present disclosure, the first power supply voltage is less than the second power supply voltage, and both the first power supply voltage and the second power supply voltage are DC voltages.

For example, in the pixel driving circuit provided by an embodiment of the present disclosure, a second electrode of the light-emitting element is connected to a third power supply input terminal, and the light-emitting element is an organic light-emitting diode.

For example, the pixel driving circuit provided by an embodiment of the present disclosure further comprises a data writing sub-circuit, a storage sub-circuit, and a second compensation sub-circuit; the driving sub-circuit comprises a first transistor, the control terminal of the driving sub-circuit is a gate electrode of the first transistor, the first terminal of the driving sub-circuit is a first electrode of the first transistor, and the second terminal of the driving sub-circuit is a second electrode of the first transistor; the reset sub-circuit comprises a second transistor, a gate electrode of the second transistor is connected to the first driving signal terminal, a first electrode of the second transistor is connected to the first power supply input terminal, and a second electrode of the second transistor is connected to the first electrode of the light-emitting element; the first compensation sub-circuit comprises a third transistor, a gate electrode of the third transistor is connected to the first driving signal terminal, a first electrode of the third transistor is connected to the gate electrode of the first transistor, and a second electrode of the third transistor is connected to the second electrode of the first transistor; the light-emitting control sub-circuit comprises a fourth transistor, a gate electrode of the fourth transistor is connected to the second driving signal terminal, a first electrode of the fourth transistor is connected to the second electrode of the first transistor, and a second electrode of the fourth transistor is connected to the first electrode of the light-emitting element; the storage sub-circuit comprises a capacitor, the first terminal of the storage sub-circuit comprises a first electrode of the capacitor, the second terminal of the storage sub-circuit comprises a second electrode of the capacitor, and the first electrode of the capacitor is connected to the gate electrode of the first transistor; the data writing sub-circuit comprises a fifth transistor, a gate electrode of the fifth transistor is connected to the third driving signal terminal, a first electrode of the fifth transistor is connected to the data signal terminal, and a second electrode of the fifth transistor is connected to the second electrode of the capacitor; and the second compensation sub-circuit comprises a sixth transistor, a gate electrode of the sixth transistor is connected to the third driving signal terminal, a first electrode of the sixth transistor is connected to the second electrode of the fifth transistor, and a second electrode of the sixth transistor is connected to the first electrode of the first transistor.

At least one embodiment of the present disclosure also provides a display panel including the pixel driving circuit as described in any one of the above embodiments.

At least one embodiment of the present disclosure also provides a driving method for driving the pixel driving circuit according to any one of the above embodiments, the driving method includes: in the initialization phase, providing the second power supply voltage to the first terminal of the driving sub-circuit, and providing, through the reset sub-circuit, the light-emitting control sub-circuit, and the first compensation sub-circuit, the first power supply voltage to the control terminal of the driving sub-circuit to cause the driving sub-circuit to be in an on-bias state; in a compensation phase, compensating a threshold voltage of the driving sub-circuit; and in a light-emitting phase, driving the light-emitting element to emit light.

For example, the driving method provided by an embodiment of the present disclosure further includes: in the initialization phase, providing the first power supply voltage to the first electrode of the light-emitting element to reset the light-emitting element For example, in the driving method provided by an embodiment of the present disclosure, the first driving signal is at a first level in the initialization phase, and the second driving signal is at the first level in the initialization phase.

For example, in the driving method provided by an embodiment of the present disclosure, the first driving signal is at the first level in the compensation phase, the second driving signal is at a second level in the compensation phase, the first driving signal is at the second level in the light-emitting phase, and the second driving signal is at the first level in the light-emitting phase; and the second level is opposite to the first level, and in terms of timing sequence, the compensation phase is after the initialization phase and the light-emitting phase is after the compensation phase in timing.

Additional aspects and advantages of the present disclosure will be set forth in part in the following descriptions, and parts of the additional aspects and the advantages will be apparent from the following descriptions, or may be learned through practice of the present disclosure.

BRIEF DESCRIPTION OF THE DRAWINGS

In order to clearly illustrate the technical solutions of the embodiments of the present disclosure, the drawings of the embodiments will be briefly described in the following; it is obvious that the described drawings are only related to some embodiments of the present disclosure and thus are not limitative to the present disclosure.

DETAILED DESCRIPTION

Figure 1:
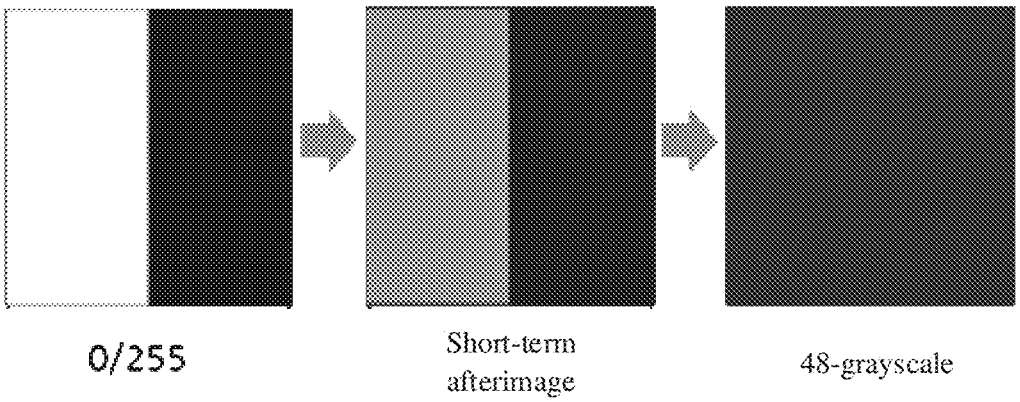
FIG. 1 is a schematic diagram showing a hysteresis effect.

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Embodiments of the present disclosure are described in detail below, examples of the embodiments are illustrated in the accompanying drawings, and the same or similar reference numerals are used to indicate the same or similar elements or elements having the same or similar functions. The embodiments described below with reference to the accompanying drawings are exemplary, are intended to explain the present disclosure, and should not be construed as limiting the present disclosure.

A display panel, a pixel driving circuit and a driving method thereof provided by an embodiment of the present disclosure will be described below with reference to the accompanying drawings.

First of all, the hysteresis effect and a reason of causing the short-term afterimage are briefly introduced.

Figure 2:
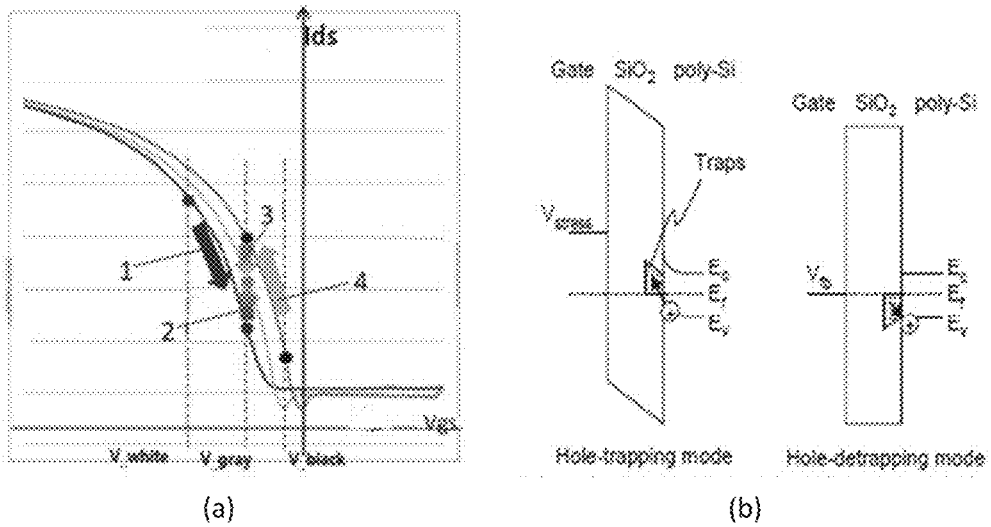
FIG. 2 is a schematic diagram of a principle of the hysteresis effect.

For example, as shown in FIG. 2, in the case where the picture changes from white (V_white) to gray (V_gray) (for example, an arrow 1 and an arrow 2), a threshold voltage of a transistor is positively biased (Hole DeTrapping), or in the case where the picture changes from black (V_black) to gray (for example, an arrow 3 and an arrow 4), the threshold voltage of the transistor is negatively biased (Hole Trapping), the hysteresis effect is mainly caused by the shift of the threshold voltage Vth of the transistor due to Hole DeTrapping/Hole trapping (or trapping and releasing of residual movable ions). According to FIG. 2(*a*), in the case where a gate-source voltage Vgs of the transistor is smaller, the more charges are trapped by an interface between an active layer and a gate electrode (ACT/GI) of the transistor, and therefore, the threshold voltage Vth of the transistor is negatively biased (Hole Trapping); in the case where the gate-source voltage Vgs of the transistor is larger, the charges trapped by the interface between the active layer and the gate electrode (ACT/GI) of the transistor will be released, and therefore, the threshold voltage Vth of the transistor will be positively biased (Hole DeTrapping). In a compensation circuit currently used, because gate-source voltages Vgs of transistors are different in an initialization phase in a case of switching different pictures, trapping/detrapping modes of holes are different, thereby resulting in short-term afterimage. In addition, FIG. 2(*b*) is a schematic diagram of a hole-trapping mode and a hole-detrapping mode. It should be noted that in FIG. 2(*a*), the abscissa represents the gate-source voltage Vgs of the transistor, and the ordinate represents a source-drain current Id of the transistor. In FIG. 2(*b*), Gate represents a gate layer, $SiO_2$ represents a gate insulating layer, and poly-Si represents an active layer.

The embodiments of the present disclosure provide a display panel, and a pixel driving circuit and a driving method thereof. In the pixel driving circuit, in an initialization phase, a first power supply voltage and a second power supply voltage can be input to a control terminal and a first terminal of the driving sub-circuit, respectively, so that the driving sub-circuit is in a fixed bias state, regardless of whether a data voltage of a previous frame is a voltage for displaying a black picture or a white picture, so that in a next frame, the driving sub-circuit starts to write and compensate the data voltage from the fixed bias state. The data voltage of the display picture of the next frame is not affected by the data voltage of the display picture of the previous frame, thus greatly ameliorating the short-term afterimage problem caused by the hysteresis effect, improving the display quality of the display panel, and effectively improving the user experience.

Figure 3:
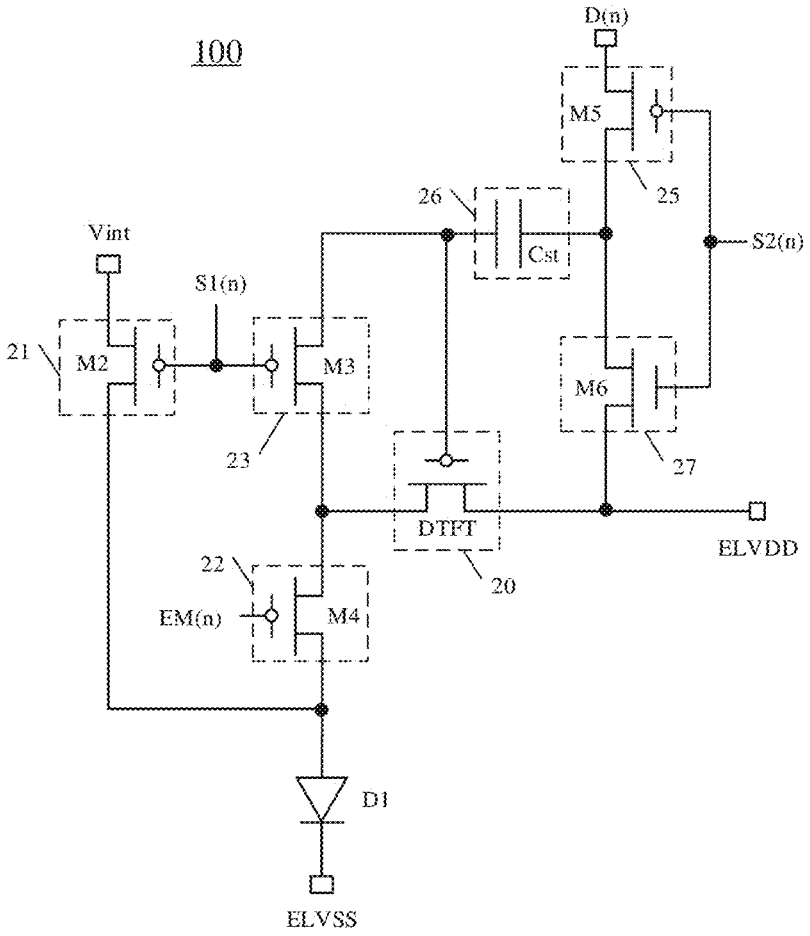
FIG. 3 is a structural schematic diagram of a pixel driving circuit according to at least one embodiment of the present disclosure.

FIG. 3 is a structural schematic diagram of a pixel driving circuit provided by at least one embodiment of the present disclosure. The pixel driving circuit may be used to drive a light-emitting diode to emit light.

For example, as shown in FIG. 3, the pixel driving circuit 100 includes a driving sub-circuit 20, a light-emitting element D1, a reset sub-circuit 21, a light-emitting control sub-circuit 22, and a first compensation sub-circuit 23. As shown in FIG. 3, the pixel driving circuit further includes a first power supply input terminal Vint, a second power supply input terminal ELVDD, a third power supply input terminal ELVSS, a first driving signal terminal S1(*n*), a third driving signal terminal S2(*n*), a second driving signal terminal EM(n), and a data signal terminal D(n).

For example, the first power supply input terminal Vint is used for inputting (i.e., providing) a first power supply voltage; the second power supply input terminal ELVDD is used for inputting a second power supply voltage; the first driving signal terminal S1(*n*) is used for inputting a first driving signal, and the first driving signal can be at a first level in an initialization phase of a process of picture switching; the second driving signal terminal EM(n) is used for inputting a second driving signal, and the second driving signal is at a first level in the initialization phase; the third driving signal terminal S2(*n*) is used for inputting a third driving signal, and the third driving signal is at a first level in the initialization phase; and the data signal terminal D(n) is used for inputting the data voltage.

For example, as shown in FIG. 3, the reset sub-circuit 21 is connected to the first power supply input terminal Vint, the first driving signal terminal S1(*n*), the light-emitting control sub-circuit 22, and a first electrode of the light-emitting element D1. The light-emitting control sub-circuit 22 is also connected to the second driving signal terminal EM(n), a second terminal of the driving sub-circuit 20, and the first electrode of the light-emitting element D1. The first compensation sub-circuit 23 is connected to the first driving signal terminal S1(*n*), the second terminal of the driving sub-circuit 20, and a control terminal of the driving sub-circuit 20.

For example, the reset sub-circuit 21, the light-emitting control sub-circuit 22, and the first compensation sub-circuit 23 are configured to, in the initialization phase, under control of the first driving signal provided by the first driving signal terminal (n) and the second driving signal provided by the second driving signal terminal EM(n), provide the first power supply voltage provided by the first power supply input terminal Vint to the control terminal of the driving sub-circuit 20.

For example, the reset sub-circuit 21 is further configured to provide the first power supply voltage to the first electrode of the light-emitting element D1 to reset the first electrode of the light-emitting element D1 under control of the first driving signal in the initialization phase.

For example, as shown in FIG. 3, the first terminal of the driving sub-circuit 20 is connected to the second power supply input terminal ELVDD to receive the second power supply voltage; and the first power supply voltage and the second power supply voltage are configured to cause the driving sub-circuit 20 to be in an on-bias state in the initialization phase.

For example, the driving sub-circuit 20 includes a first transistor DTFT (i.e., a driving transistor), the control terminal of the driving sub-circuit 20 is a gate electrode of the first transistor DTFT, the first terminal of the driving sub-circuit 20 is a first electrode of the first transistor DTFT, and the second terminal of the driving sub-circuit 20 is a second electrode of the first transistor DTFT. That is, the gate electrode and the second electrode of the first transistor DTFT are both connected to the first compensation sub-circuit 23, and the first electrode of the first transistor DTFT is connected to the second power supply input terminal ELVDD to receive the second power supply voltage. "The driving sub-circuit 20 is in an on-bias state" may indicate that the first transistor DTFT is in an on-bias state, that is, the first power supply voltage and the second power supply voltage may control the first transistor DTFT to be in an on-bias state in the initialization phase.

For example, as shown in FIG. 3, the first electrode of the first transistor DTFT is directly connected to the second power supply input terminal ELVDD.

For example, the first transistor DTFT may be a P-type transistor. The first electrode of the first transistor DTFT may be a source electrode and the second electrode of the first transistor DTFT may be a drain electrode. In the description of the present disclosure, "the first transistor DTFT is in an on-bias state" may indicate that an absolute value of a voltage difference Vgs between the gate electrode and the source electrode of the first transistor DTFT is not less than an absolute value of a threshold voltage of the first transistor DTFT, that is, the absolute value of Vgs of the first transistor DTFT is greater than or equal to the absolute value of the threshold voltage of the first transistor DTFT. It should be noted that in the present disclosure, the "on-bias state" may indicate that the voltage difference between the gate electrode and the source electrode of the first transistor DTFT is a fixed value, so that in the present disclosure, both the first power supply voltage and the second power supply voltage are constant voltages. For example, in the case where the first transistor DTFT is a P-type transistor, the "on-bias state" may indicate that the voltage difference Vgs between the gate electrode and the source electrode of the first transistor DTFT is less than or equal to the threshold voltage of the first transistor DTFT; and in the case where the first transistor DTFT is an N-type transistor, the "on-bias state" may indicate that the voltage difference Vgs between the gate electrode and the source electrode of the first transistor DTFT is greater than or equal to the threshold voltage of the first transistor DTFT. In the case where the first transistor DTFT is in an on-bias state, although the first transistor DTFT is turned on, no current flows through the first transistor DTFT.

For example, the light-emitting element D1 is configured to emit light in the case where a voltage or a current is applied to the light-emitting element D1. The light-emitting element D1 may be a light-emitting diode, and the light-emitting diode may be, for example, an organic light-emitting diode OLED, a quantum dot light-emitting diode QLED, or the like, but embodiments of the present disclosure are not limited thereto. The light-emitting elements D1 may respectively adopt different light-emitting materials, for example, to emit light of different colors, thereby performing color light emitting.

For example, a second electrode of the light-emitting element D1 is connected to the third power supply input terminal ELVSS to receive a third power supply voltage. In some examples, the first electrode of the light-emitting element D1 may be an anode and the second electrode of the light-emitting element D1 may be a cathode.

For example, both the first power supply voltage and the second power supply voltage may be DC voltages. For example, the first power supply voltage is less than the second power supply voltage. In some examples, the first power supply voltage may be a low-level voltage and the second power supply voltage may be a high-level voltage. In this case, the first power supply input terminal Vint is a low power supply input terminal and the second power supply input terminal ELVDD is a high power supply input terminal.

For example, the third power supply input terminal ELVSS may be a low power supply input terminal, so that the third power supply voltage is a low level voltage. The third power supply voltage is less than the second power supply voltage. In some embodiments, the second power supply input terminal ELVDD may be electrically connected to a positive pole of a power supply. The third power supply input terminal ELVSS may be electrically connected to a negative pole of the power supply. The third power supply input terminal ELVSS may also be electrically connected to a ground terminal (GND), that is, the second electrode of the light-emitting element D1 is connected to the ground terminal (GND).

For example, in some embodiments, the reset sub-circuit 21, the light-emitting control sub-circuit 22, and the first compensation sub-circuit 23 may constitute a first driving unit, that is, the first driving unit 31 is connected to the first power supply input terminal Vint, the first driving signal terminal S1(*n*), the second driving signal terminal EM(n), the second terminal of the first transistor DTFT, the control terminal of the first transistor DTFT, and the anode of the light-emitting diode D1, respectively. The first driving unit 31 is used to, in the initialization phase, under control of the first driving signal and the second driving signal, enable a voltage at the control terminal of the first transistor DTFT to be equal to the first power supply voltage.

According to the pixel driving circuit of the embodiments of the present disclosure, the first power supply voltage can be input through the first power supply input terminal, the second power supply voltage can be input through the second power supply input terminal, the first driving signal can be input through the first driving signal terminal, the second driving signal can be input through the second driving signal terminal, the data voltage can be input through the data signal terminal, and in the initialization phase, under control of the first driving signal and the second driving signal, the first drive unit can enable a voltage of the gate electrode of the first transistor to be equal to the first power supply voltage, and enable a voltage of the first electrode of the first transistor to be equal to the second power supply voltage. Thus, in the initialization phase, the first power supply voltage and the second power supply voltage are input to the gate electrode and the source electrode (i.e., the first electrode) of the first transistor DTFT, respectively, so that the first transistor DTFT is in a fixed bias state (e.g., on-bias state), regardless of whether the data voltage of the previous frame is a voltage for displaying a black picture or a white picture, the first transistor DTFT starts to write and compensate the data voltage from the fixed bias state, the data voltage of the display picture of the next frame is not affected by the data voltage of the display picture of the previous frame, the short-term afterimage problem caused by the hysteresis effect is greatly ameliorated, the display quality of the display panel is improved, and the user experience is effectively improved.

For example, as shown in FIG. 3, the pixel driving circuit 100 further includes a data writing sub-circuit 25 and a storage sub-circuit 26.

For example, the data writing sub-circuit 25 is connected to the third driving signal terminal S2(*n*), the data signal terminal D(n), and a first terminal of the storage sub-circuit 26, respectively, and is configured to, in the initialization phase, under control of the third driving signal provided by the third driving signal terminal S2(*n*), write the data voltage provided by the data signal terminal D(n) to the first terminal of the storage sub-circuit 26. A second terminal of the storage sub-circuit 26 is connected to the gate electrode of the first transistor DTFT, and the storage sub-circuit 26 is configured to store the data voltage.

For example, as shown in FIG. 3, the pixel driving circuit 100 further includes a second compensation sub-circuit 27. The second compensation sub-circuit 27 is connected to the third driving signal terminal S2(*n*), the first terminal of the storage sub-circuit 26, and the second power supply input terminal ELVDD, respectively, and is configured to, in the compensation phase, under control of the third driving signal, provide the second power supply voltage to the first terminal of the storage sub-circuit 26.

For example, the second compensation sub-circuit 27 is further configured to disconnect a connection between the first terminal of the storage sub-circuit 26 and the second power supply input terminal ELVDD in the initialization phase, that is, the voltage of the first electrode of the first transistor DTFT is equal to the second power supply voltage in the initialization phase.

For example, in some embodiments, the data writing sub-circuit 25, the storage sub-circuit 26, and the second compensation sub-circuit 27 may constitute a second driving unit, the second driving unit is connected to the data signal terminal D(n), the gate electrode of the first transistor DTFT, the second power supply input terminal ELVDD, and the first driving signal terminal S1(*n*), respectively, and the second driving unit is used to, in the initialization phase, under control of the second driving signal, make the voltage of the first electrode of the first transistor DTFT be equal to the second power supply voltage.

For example, as shown in FIG. 3, according to an embodiment of the present disclosure, the reset sub-circuit includes a second transistor M2, the first compensation sub-circuit 23 includes a third transistor M3, and the light-emitting control sub-circuit 22 includes a fourth transistor M4. A gate electrode of the second transistor M2 is connected to the first driving signal terminal S1(*n*), a first electrode of the second transistor M2 is connected to the first power supply input terminal Vint, and a second electrode of the second transistor M2 is connected to the first electrode of the light-emitting element D1 (i.e., the anode of the light-emitting diode). A gate electrode of the third transistor M3 is connected to the first driving signal terminal S1(*n*), a first electrode of the third transistor M3 is connected to the gate electrode of the first transistor DTFT, and a second electrode of the third transistor M3 is connected to the second electrode of the first transistor DTFT. A gate electrode of the fourth transistor M4 is connected to the second driving signal terminal EM(n), a first electrode of the fourth transistor M4 is connected to the second electrode of the first transistor DTFT, and a second electrode of the fourth transistor M4 is connected to the first electrode of the light-emitting element D1 (i.e., the anode of the light-emitting diode).

For example, in the embodiment of the present disclosure, the second transistor M2 and the third transistor M3 controlled by the first driving signal are of the same type, that is, the second transistor M2 and the third transistor M3 are both N-type transistors, or both are P-type transistors. For example, in the example shown in FIG. 3, the second transistor M2 and the third transistor M3 are both P-type transistors.

For example, an electrical characteristic of the first transistor DTFT, an electrical characteristic of the second transistor M2, an electrical characteristic of the third transistor M3, and an electrical characteristic of the fourth transistor M4 are all the same. The first transistor DTFT, the second transistor M2, the third transistor M3, and the fourth transistor M4 are all thin film transistors (TFT for short), such as P-type thin film transistors (for example, PMOS). However, the present disclosure is not limited to this case, and the electrical characteristic of any one selected from a group consisting of the second transistor M2, the third transistor M3, and the fourth transistor M4 may be different from the electrical characteristic of the first transistor DTFT according to actual design requirements.

Specifically, TFT generally refers to a thin film liquid crystal display, and actually refers to a thin film transistor (matrix), which can "actively" control individual pixels on a screen. Specifically, the display screen comprises many pixels that can emit light of any color, so long as respective pixels are controlled to display corresponding colors, the purpose can be achieved.

It should be noted that in the example as shown in FIG. 3, the gate electrode of the second transistor M2 and the gate electrode of the third transistor M3 are both connected to the first driving signal terminal S1(*n*) to receive the same first driving signal, but the present disclosure is not limited thereto. The gate electrode of the second transistor M2 and the gate electrode of the third transistor M3 may also be connected to different driving signal terminals, respectively, and the driving signals provided by the different driving signal terminals are the same. Alternatively, the gate electrode of the second transistor M2 and the gate electrode of the third transistor M3 may be connected to different driving signal terminals to receive different driving signals, respectively, thereby increasing the timing flexibility of the pixel driving circuit.

For example, as shown in FIG. 3, the storage sub-circuit 26 includes a capacitor Cst, the data writing sub-circuit 25 includes a fifth transistor M5, and the second compensation sub-circuit 27 includes a sixth transistor M6. For example, the first terminal of the storage sub-circuit 26 includes a first electrode of the capacitor Cst, the second terminal of the storage sub-circuit 26 includes a second electrode of the capacitor Cst, and the first electrode of the capacitor Cst is connected to the gate electrode of the first transistor DTFT. A gate electrode of the fifth transistor M5 is connected to the third driving signal terminal S2(*n*), a first electrode of the fifth transistor M5 is connected to the data signal terminal D(n), and a second electrode of the fifth transistor M5 is connected to the second electrode of the capacitor Cst. A gate electrode of the sixth transistor M6 is connected to the third driving signal terminal S2(*n*), a first electrode of the sixth transistor M6 is connected to the second electrode of the fifth transistor M5, and a second electrode of the sixth transistor M6 is connected to the first electrode of the first transistor DTFT.

For example, an electrical characteristic of the fifth transistor M5 is the same as the electrical characteristic of the first transistor DTFT, an electrical characteristic of the sixth transistor M6 is opposite to the electrical characteristic of the first transistor DTFT, and the electrical characteristic of the fifth transistor M5 is opposite to the electrical characteristic of the sixth transistor M6. For example, the first transistor DTFT and the fifth transistor M5 are both P-type thin film transistors, and the sixth transistor M6 is an N-type thin film transistor (e.g., NMOS).

For example, in the embodiments of the present disclosure, the fifth transistor M5 and the sixth transistor M6 controlled by the third driving signal are of opposite types, that is, one of the fifth transistor M5 and the sixth transistor M6 is an N-type transistor and the other of the fifth transistor M5 and the sixth transistor M6 is a P-type transistor. For example, in the example as shown in FIG. 3, the fifth transistor M5 is a P-type transistor, and the sixth transistor M6 is an N-type transistor.

For example, in some embodiments, the first driving signal is identical to the third driving signal, for example, the first driving signal terminal S1(*n*) and the third driving signal terminal S2(*n*) are the same signal terminal, so that the amount of signal terminals can be saved. In this case, the gate electrode of the second transistor M2, the gate electrode of the third transistor M3, the gate electrode of the fifth transistor M5, and the gate electrode of the sixth transistor M6 are all connected to the same signal terminal, for example, the first driving signal terminal S1(*n*).

For example, the first driving signal is at a first level in the compensation phase, the second driving signal is at a second level in the compensation phase, the second level is opposite to the first level, and in terms of timing sequence, the compensation phase is after the initialization phase. For example, in the example as shown in FIG. 3, the first level may be a low level and the second level may be a high level.

It should be noted that "the second level is opposite to the first level" indicates that in a case where an electrical characteristic of a transistor controlled by the first driving signal and an electrical characteristic of a transistor controlled by the second driving signal are the same, in the compensation phase, the transistor controlled by the first driving signal and the transistor controlled by the second driving signal are in opposite states, respectively, for example, in a case where the transistor controlled by the first driving signal is turned on, the transistor controlled by the second driving signal is turned off; alternatively, in a case where the transistor controlled by the first driving signal is turned off, the transistor controlled by the second driving signal is turned on. It should be noted that if the electrical characteristic of the transistor controlled by the first driving signal and the electrical characteristic of the transistor controlled by the second driving signal are different, for example, in the case where the transistor controlled by the first driving signal is a P-type transistor and the transistor controlled by the second driving signal is an N-type transistor, in the compensation phase, the first driving signal and the second driving signal may be at the same level, for example, the first level.

For example, the first driving signal is at the second level in the light-emitting phase, the second driving signal is at the first level in the light-emitting phase, and the light-emitting phase is after the compensation phase in terms of timing sequence.

In the embodiment of the present disclosure, "first level" and "second level" are set by taking the case where the first transistor to the fifth transistor are P-type transistors and the sixth transistor may be N-type transistor as an example. The present disclosure includes but is not limited to this case. If the type of any one of the first transistor to the sixth transistor in the present disclosure changes, levels of respective driving signals need to change accordingly.

It can be understood that in the example as shown in FIG. 3, the gate electrode of the fifth transistor M5 and the gate electrode of the sixth transistor M6 are both connected to the third driving signal terminal S2(*n*) to receive the same third driving signal, but the present disclosure is not limited thereto. The gate electrode of the fifth transistor M5 and the gate electrode of the sixth transistor M6 may also be connected to different driving signal terminals, respectively, and the driving signals provided by the different driving signal terminals are the same. Alternatively, the gate electrode of the fifth transistor M5 and the gate electrode of the sixth transistor M6 may be connected to different driving signal terminals to receive different driving signals, respectively, thereby increasing the timing flexibility of the pixel driving circuit. For example, in the case where the gate electrode of the fifth transistor M5 and the gate electrode of the sixth transistor M6 receive different driving signals, respectively, the fifth transistor M5 and the sixth transistor M6 may both be P-type thin film transistors.

It should be noted that the structure of the pixel driving circuit as shown in FIG. 3 is exemplary only. According to actual design requirements, specific structures of the reset sub-circuit, the first compensation sub-circuit, the second compensation sub-circuit, the light-emitting control sub-circuit, the data writing sub-circuit, and the like in the pixel driving circuit can be set according to actual application requirements, and the embodiments of the present disclosure are not specifically limited to this case. For example, according to actual design requirements, the pixel driving circuit may also have a voltage drop compensation function to compensate for the display voltage difference of the light-emitting element D1 caused by the power supply voltage drop (IR drop) of the display panel, thereby improving the display quality and the display effect.

It is worth noting that according to the characteristics of transistors, transistors can be divided into N-type transistors and P-type transistors. For the sake of clarity, the embodiment of the present disclosure takes the case where the first transistor to fifth transistor are P-type transistors and the sixth transistor is N-type transistor as examples to elaborate the technical solution of the present disclosure in detail. However, the transistors of the embodiments of the present disclosure are not limited to this case, and those skilled in the art can achieve the functions of one or more transistors in the embodiments of the present disclosure by using P-type transistors or N-type transistors according to actual needs.

In the embodiments of the present disclosure, the first electrode of the transistor may be a source electrode or a drain electrode, and accordingly, the second electrode of the transistor may be a drain electrode or a source electrode. Therefore, the first electrode and the second electrode of all or part of the transistors in the embodiment of the present disclosure are interchangeable as required. For different types of transistors, control signals of gate electrodes of the transistor are also different. For example, for an N-type transistor, in the case where the control signal is a high-level signal, the N-type transistor is in a turn-on state; in the case where the control signal is a low-level signal, the N-type transistor is in a turn-off state. For a P-type transistor, in the case where the control signal is a low-level signal, the P-type transistor is in a turn-on state; and in a case where the control signal is a high-level signal, the P-type transistor is in a turn-off state. The control signal in the embodiments of the present disclosure may be changed correspondingly according to the type of transistor.

Figure 4A:
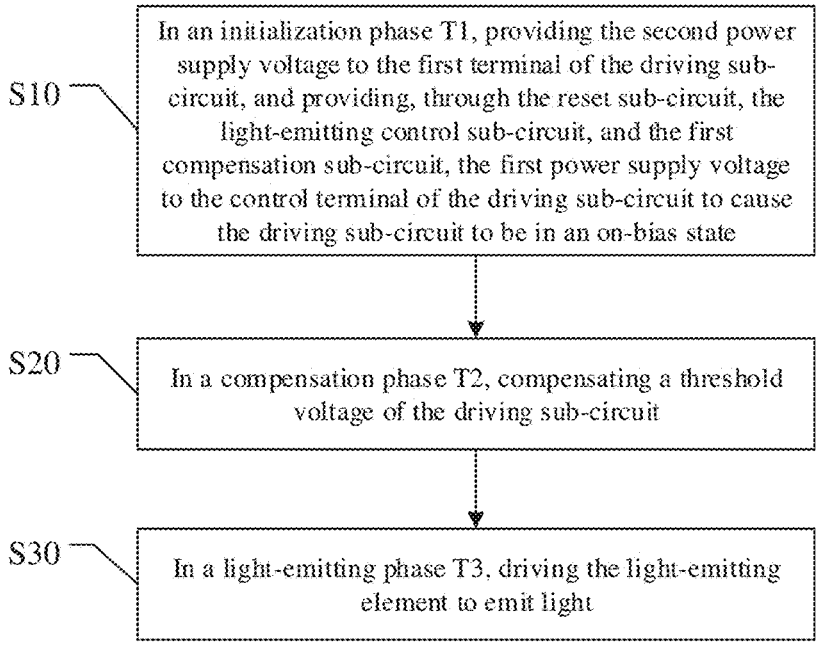
FIG. 4A is a flowchart of a driving method for driving a pixel driving circuit according to at least one embodiment of the present disclosure.
Figure 4B:
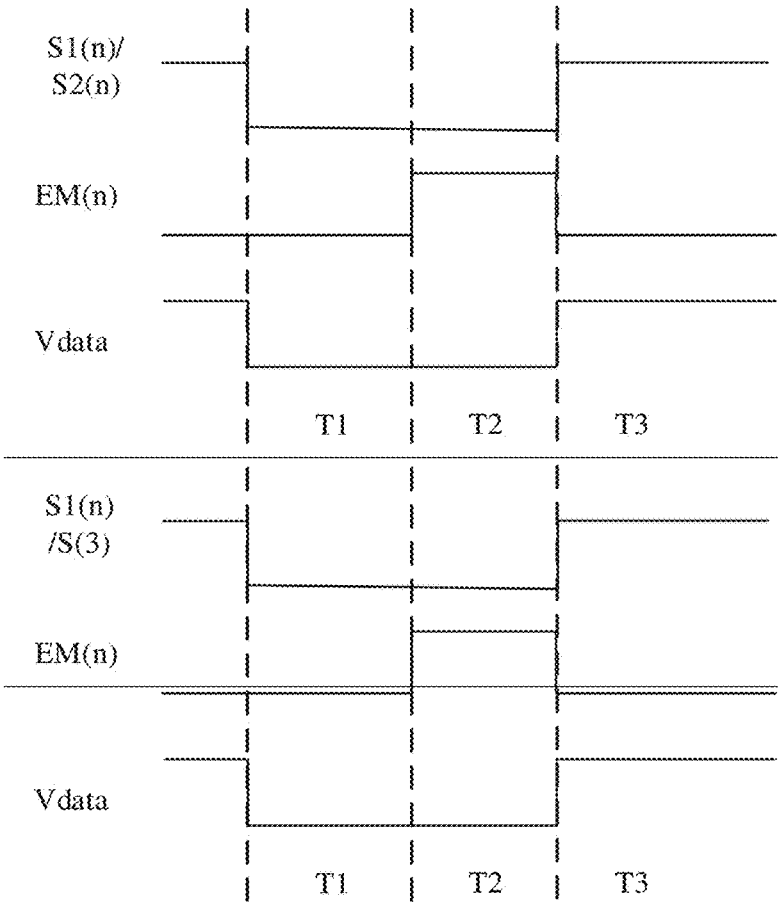
FIG. 4B is a schematic diagram of an operation timing of a pixel driving circuit according to at least one embodiment of the present disclosure.

At least one embodiment of the present disclosure also provides a driving method that can drive the pixel driving circuit described in any one of the above embodiments. FIG. 4A is a flowchart of a driving method for driving a pixel driving circuit according to at least one embodiment of the present disclosure, and FIG. 4B is a schematic diagram of an operation timing of a pixel driving circuit according to at least one embodiment of the present disclosure.

For example, the driving method for driving the pixel driving circuit includes:

S10: In an initialization phase T1, providing the second power supply voltage to the first terminal of the driving sub-circuit, and providing, through the reset sub-circuit, the light-emitting control sub-circuit, and the first compensation sub-circuit, the first power supply voltage to the control terminal of the driving sub-circuit to cause the driving sub-circuit to be in an on-bias state;

S20: In a compensation phase T2, compensating a threshold voltage of the driving sub-circuit;

S30: In a light-emitting phase T3, driving the light-emitting element to emit light.

For example, the timing chart of the pixel driving circuit can be set according to actual requirements, and the embodiments of the present disclosure do not specifically limit the timing chart of the pixel driving circuit.

For example, in some embodiments, an exemplary operation timing of the pixel driving circuit in the embodiment of the present disclosure may be as shown in FIG. 4B.

Figure 5:
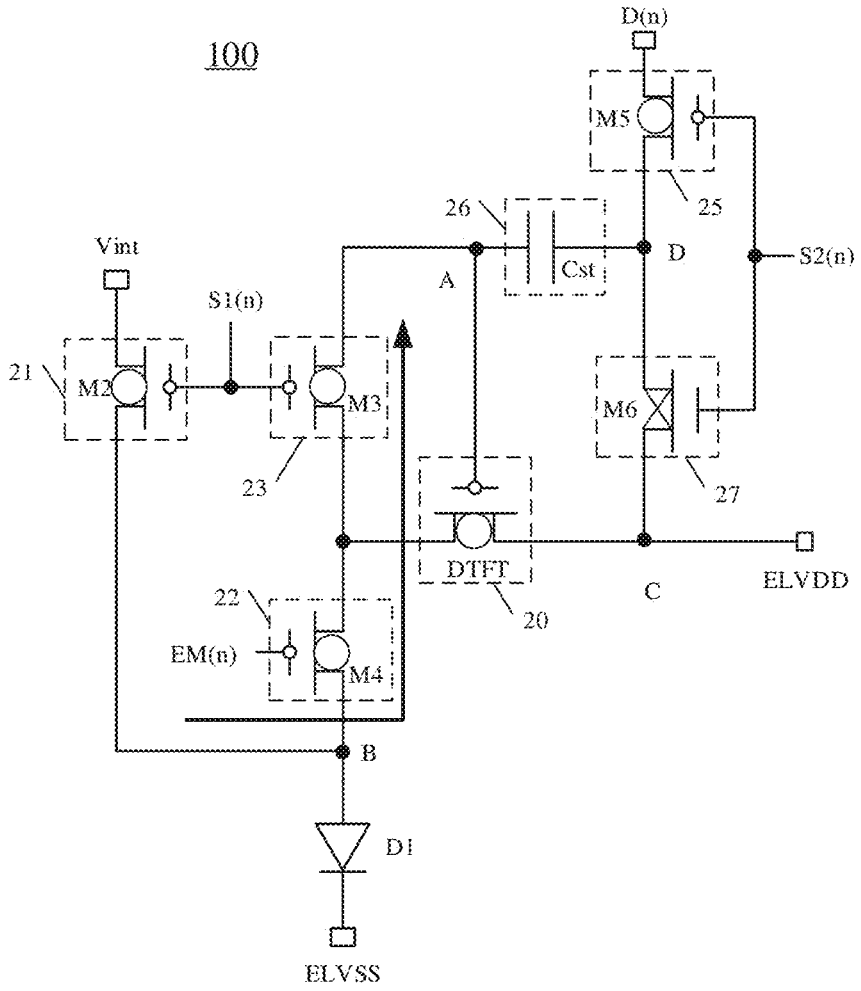
FIG. 5 is a schematic diagram of a circuit structure of a pixel driving circuit in an initialization phase according to at least one embodiment of the present disclosure.
Figure 6:
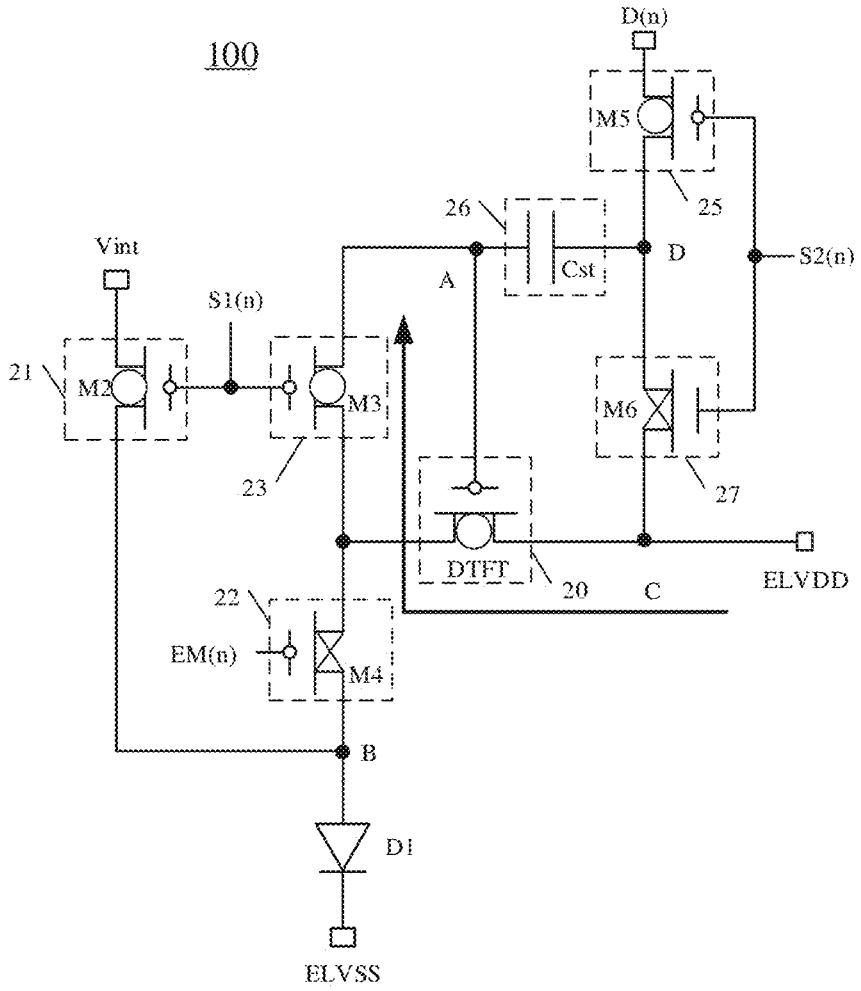
FIG. 6 is a schematic diagram of a circuit structure of a pixel driving circuit in a compensation phase according to at least one embodiment of the present disclosure.
Figure 7:
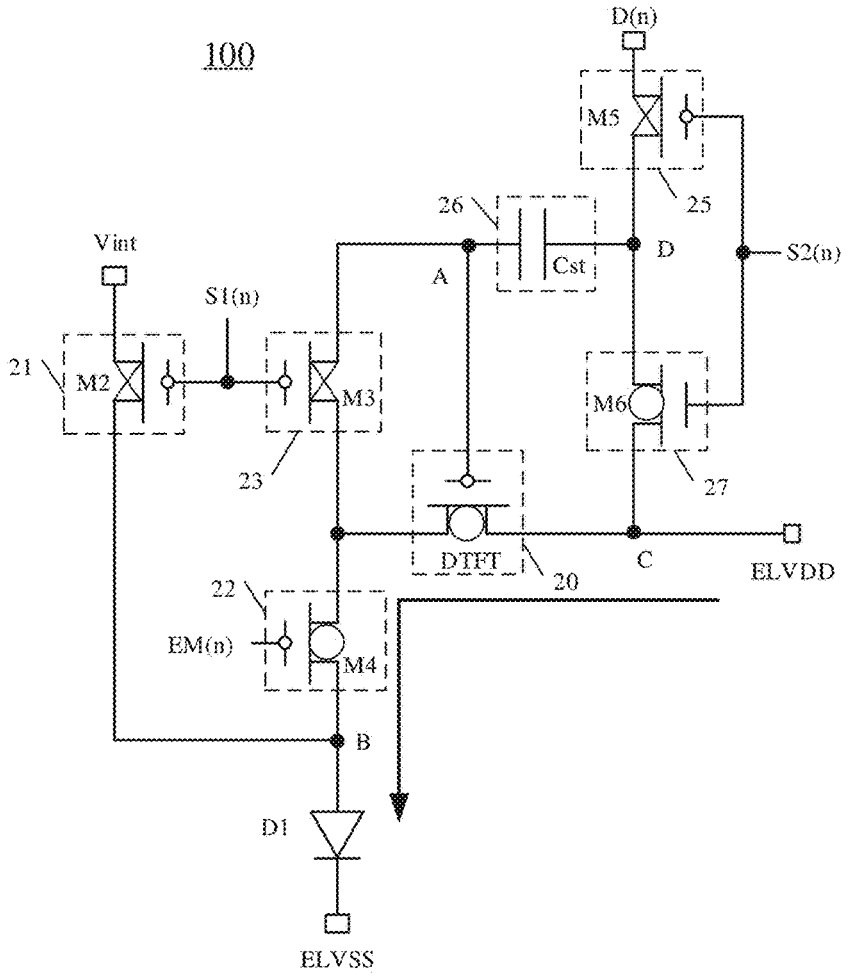
FIG. 7 is a schematic diagram of a circuit structure of a pixel driving circuit in a light-emitting phase according to at least one embodiment of the present disclosure.

For example, FIGS. 5 to 7 are schematic diagrams of the pixel driving circuit as shown in FIG. 3 at respective operation phases. The operation flow of the driving method of the pixel driving circuit provided by the embodiment of the present disclosure will be described in detail below with reference to FIGS. 4B and 5 to 7. It should be noted that the setting modes of the initialization phase T1, the compensation phase T2, and the light-emitting phase T3 can be set according to actual application requirements, and the embodiment of the present disclosure is not specifically limited to this case.

It should be noted that in FIGS. 5 to 7, a cross (×) symbol is set at a position of the transistor to indicate that the transistor is in a turn-off state, and a circle (○) symbol at a position of the transistor indicates that the transistor is in a turn-on state. Solid lines with arrows indicate a signal flow direction. In the following description, ELVDD, ELVSS, S1(*n*), S2(*n*), EM(n), Vint, etc. represent both corresponding signal terminals and corresponding signals.

For example, according to an embodiment of the present disclosure, as shown in FIG. 4B, both the first driving signal and the second driving signal may be at a first level (e.g., a low level) in the initialization phase T1 of the process of picture switching.

For example, as shown in FIGS. 4B and 5, in the initialization phase T1, the first driving signal S1(*n*) provided by the first driving signal terminal S1(*n*) and the second driving signal EM(n) provided by the second driving signal terminal EM(n) are both at the first level, and the first level may be a low level, so that the second transistor M2, the third transistor M3, and the fourth transistor M4 are all turned on; and the first power supply voltage Vint provided by the first power supply input terminal Vint may be written to the gate electrode of the first transistor DTFT (i.e., node A in the figure) through the second transistor M2, the third transistor M3, and the fourth transistor M4 to reset the gate electrode of the first transistor DTFT, a voltage Vgate of the gate electrode of the first transistor DTFT is Vint; the second power supply voltage ELVDD provided by the second power supply input terminal ELVDD is written to the first electrode (i.e., a source electrode, node C in the figure) of the first transistor DTFT, so that a voltage Vsource of the first electrode of the first transistor DTFT is ELVDD, a gate-source voltage Vgs of the first transistor DTFT is Vint-ELVDD, thereby forming a fixed bias voltage, that is, the first power supply voltage Vint and the second power supply voltage ELVDD can enable the first transistor DTFT to be in an on-bias state, thereby ameliorating the short-term after-image of the light-emitting element D1 (such as the organic light-emitting diode OLED).

It should be noted that in the case where the first power supply voltage Vint is written to the gate electrode of the first transistor DTFT, the first transistor DTFT can be turned on because the first power supply voltage Vint is a low-level power supply.

Meanwhile, in the initialization phase T1, the first power supply voltage provided by the first power supply input terminal Vint is written to the first electrode of the light-emitting element D1 (i.e., node B in FIG. 5) through the second transistor M2 to reset the first electrode (i.e., anode) of the light-emitting element D1.

For example, in the initialization phase T1, the third driving signal S2(*n*) provided by the third driving signal terminal S2(*n*) is at the first level and the fifth transistor M5 is in a turn-on state, so that the data voltage Vdata provided by the data signal terminal D(n) is written into the second electrode of the capacitor Cst (i.e., node D in FIG. 5) through the fifth transistor M5, that is, data writing is completed in the initialization phase T1. The sixth transistor M6 is in a turn-off state, so that a connection between the second electrode of the capacitor Cst and the first electrode of the first transistor DTFT can be disconnected, thereby making the voltage of the first electrode of the first transistor DTFT be equal to the second power supply voltage, preventing the node C from colliding, and preventing the data voltage Vdata stored by the capacitor Cst from generating errors.

In summary, in the initialization phase T1, a voltage of the node A may be the first power supply voltage Vint, a voltage of the node B may be the first power supply voltage Vint, a voltage of the node C may be the second power supply voltage ELVDD, and a voltage of the node D may be the data voltage Vdata.

That is, in the example shown in FIG. 5, the fifth transistor M5, the third transistor M3, the fourth transistor M4, the second transistor M2, and the first transistor DTFT may all be P-type transistors, and the sixth transistor M6 may be an N-type transistor. During the initialization phase T1, the first power supply voltage and the second power supply voltage are input to the gate electrode and the source electrode of the first transistor DTFT, respectively, so that the first transistor DTFT is in a fixed bias state. Regardless of whether the data voltage of the previous frame is the voltage for displaying a black picture or a white picture, the first transistor DTFT starts to write and compensate the data voltage from the fixed bias state, thereby greatly ameliorating the short-term afterimage problem caused by the hysteresis effect.

For example, according to an embodiment of the present disclosure, the first driving signal is at a first level in the compensation phase T2 of the process of picture switching, the second driving signal is at a second level in the compensation phase, the second level is opposite to the first level, and the compensation phase is after the initialization phase.

For example, as shown in FIGS. 4B and 6, in the compensation phase T2, the first driving signal provided by the first driving signal terminal S1(*n*) is at the first level (i.e., low level), the second driving signal provided by the second driving signal terminal EM(n)) is at the second level, and the second level may be a high level, and the third driving signal provided by the third driving signal terminal S2(*n*) is at the first level (i.e., low level), so that the fifth transistor M5, the third transistor M3, the second transistor M2, and the first transistor DTFT are all in the turn-on state; the second power supply voltage provided by the second power supply input terminal ELVDD charges the first electrode of the capacitor Cst (i.e., node A in FIG. 6) through the first transistor DTFT and the third transistor M3, until the voltage of the first electrode of the capacitor Cst is charged to ELVDD+Vth, the first transistor DTFT is turned off, thereby stopping charging, Vth is the threshold voltage of the first transistor DTFT. Because in the case where the Vgs of a PMOS transistor is less than the Vth of the PMOS transistor, the PMOS transistor is turned on. In an initial phase of the compensation phase T2, because the voltage of the gate electrode of the first transistor DTFT is the first power supply voltage Vint and the voltage of the first electrode of the first transistor DTFT is the second power supply voltage ELVDD, at this time, the gate-source voltage Vgs of the first transistor DTFT is less than Vth, and therefore, the first transistor DTFT can be turned on. In the case where the first electrode of the capacitor Cst is charged to ELVDD+Vth, the gate-source voltage Vgs of the first transistor DTFT is equal to Vth, so that the first transistor DTFT is turned off, and in the case where the first transistor DTFT is turned off, the voltage Vgate of the gate electrode of the first transistor DTFT is equal to ELVDD+Vth.

For example, in the compensation phase T2, the second transistor M2 is still turned on, thereby continuously resetting the first electrode of the light-emitting element D1 (i.e., node B in FIG. 6); in addition, the fifth transistor M5 is still turned on, so that a voltage of the second electrode of the capacitor Cst (i.e., node D in FIG. 6) can be maintained at the data voltage Vdata.

In summary, in the compensation phase T2, in FIG. 6, the voltage of the node A is ELVDD+Vth, the voltage of the node B is the first power supply voltage Vint, the voltage of the node C is the second power supply voltage ELVDD, and the voltage of the node D is the data voltage Vdata.

According to an embodiment of the present disclosure, the first driving signal is at the second level in the light-emitting phase of the process of picture switching, the second driving signal is at the first level in the light-emitting phase, and the light-emitting phase is after the compensation phase in timing sequence.

For example, as shown in FIGS. 4B and 7, in the light-emitting phase T3, the first driving signal provided by the first driving signal terminal S1(*n*) is at the second level, the second driving signal provided by the second driving signal terminal EM(n) is at the first level, and the third driving signal provided by the third driving signal terminal S2(*n*) is at the second level (i.e., low level); the sixth transistor M6, the fourth transistor M4, and the first transistor DTFT are all in a turn-on state, and other transistors are in a turn-off state. Because the sixth transistor M6 is turned on, the second power supply voltage ELVDD provided by the second power supply input terminal ELVDD is written to the second electrode of the capacitor Cst (i.e., node D in FIG. 7), so that the voltage of the second electrode of the capacitor Cst becomes the second power supply voltage ELVDD, the change amount ΔVD in the voltage of the second electrode of the capacitor Cst is equal to (ELVDD−Vdata). Due to the existence of the capacitor Cst, the capacitor Cst has a bootstrap effect, so that the change amount ΔVA in the voltage of the first electrode of the capacitor Cst (i.e., node A in FIG. 7) is ΔVA=(ELVDD−Vdata), and therefore, the voltage of the gate electrode of the first transistor DTFT (i.e., node A in FIG. 7) changes to VG=(ELVDD+Vth)+(ELVDD−Vdata). Because the first electrode of the first transistor DTFT is connected to the second power supply input terminal ELVDD, the voltage VS of the first electrode of the first transistor DTFT is VS=ELVDD.

In summary, in the light-emitting phase T3, in FIG. 6, the voltage of the node A may be (ELVDD+Vth)+(ELVDD−Vdata), the voltage of the node C may be the second power supply voltage ELVDD, the voltage of the node D may be the second power supply voltage ELVDD, and a value of a light-emitting current holed used to drive the light-emitting element D1 to emit light may be:

$$I_{oled} \propto (Vgs - Vth)^2$$

$$I_{oled} \propto ((ELVDD + Vth + ELVDD - Vdata) - ELVDD - Vth)^2,$$

where ∝ represents proportional to.

Based on the saturation current formula of the first transistor DTFT, the light-emitting current Ioled can be:

$$I_{oled} = w * c_{ox} * u/2L * (Vdata - ELVDD)^2.$$

In the above formula, Vgs is a voltage difference between the gate electrode and the source electrode of the first transistor DTFT, Vth is the threshold voltage of the first transistor DTFT, μ is the electron mobility of the first transistor DTFT, $C_{ox}$ is a gate unit capacitance of the first transistor DTFT, W is a width of a channel of the first transistor DTFT, and L is a length of a channel of the first transistor DTFT. As can be seen from the above formula, the light-emitting current holed is not affected by the threshold voltage Vth of the first transistor DTFT, but is only related to the second power supply voltage ELVDD and the data voltage Vdata. The second power supply voltage ELVDD is directly provided to the first transistor DTFT from the second power supply input terminal ELVDD, the data voltage Vdata is directly transmitted by the data signal terminal VD, and both the second power supply voltage ELVDD and the data voltage Vdata are independent of the threshold voltage Vth of the first transistor DTFT, thus solving the problem of threshold voltage drift of the first transistor DTFT due to the process manufacturing and long-time operation. To sum up, the pixel driving circuit can ensure the accuracy of the light-emitting current holed, eliminate the influence of the threshold voltage of the first transistor DTFT on the light-emitting current holed, ensure that the light-emitting element D1 works normally, improve the uniformity of the display picture, and improve the display effect.

It should be noted that, as shown in FIG. 4B, in both the initialization phase T1 and the compensation phase T2, the data signal terminal D(n) provides the data voltage Vdata, and the data voltage Vdata has the first level. In the light-emitting phase T3, the data signal terminal D(n) may not provide the data voltage Vdata, or the data voltage Vdata may have the second level in the light-emitting phase T3.

According to the pixel driving circuit provided by the embodiments of the present disclosure, the first power supply voltage can be input through the first power supply input terminal, the second power supply voltage can be input through the second power supply input terminal, the first driving signal can be input through the first driving signal terminal, the second driving signal can be input through the second driving signal terminal, the data voltage can be input through the data signal terminal, and in the initialization phase, under control of the first driving signal and the second driving signal, the first drive unit can enable the voltage of the gate electrode of the first transistor to be equal to the first power supply voltage, and enable the voltage of the first electrode of the first transistor to be equal to the second power supply voltage. Therefore, by respectively inputting the first power supply voltage and the second power supply voltage to the gate electrode and the source electrode (i.e., the first electrode) of the first transistor DTFT in the initialization phase, the first transistor DTFT is in a fixed bias state, regardless of whether the data voltage of the previous frame is a voltage for displaying a black picture or a white picture, the first transistor DTFT starts to write and compensate the data voltage from the fixed bias state. The data voltage of the display picture of the next frame is not affected by the data voltage of the display picture of the previous frame, thus greatly ameliorating the short-term afterimage problem caused by the hysteresis effect, improving the display quality of the display panel, and effectively improving the user experience.

Figure 8:
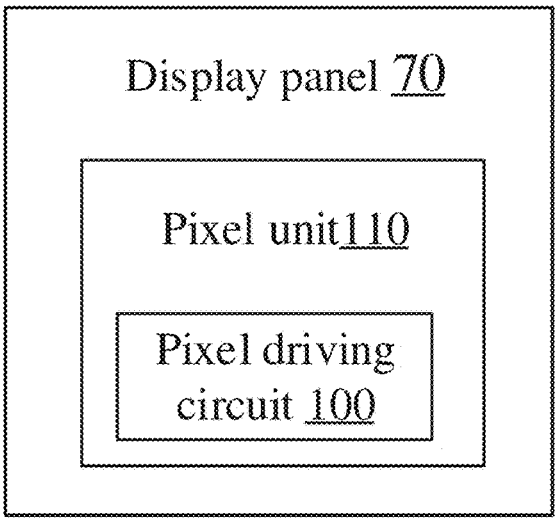
FIG. 8 is a schematic diagram of a display panel according to at least one embodiment of the present disclosure.

At least one embodiment of the present disclosure provides a display panel. FIG. 8 is a schematic block diagram of a display panel provided by an embodiment of the present disclosure. As shown in FIG. 8, the display panel 70 includes a plurality of pixel units 110, the plurality of pixel units 110 may be arranged in an array. According to actual application requirements, the display panel 70 may include, for example, pixel units 110 arranged in 1440 rows and 900 columns. Each pixel unit 110 may include the pixel driving circuit 100 described in any one of the above embodiments.

According to the display panel provided by the embodiments of the present disclosure, through the pixel driving circuit described above, in the initialization phase, the first power supply voltage and the second power supply voltage are input to the gate electrode and the source electrode (i.e., the first electrode) of the first transistor DTFT, respectively, so that the first transistor DTFT is in a fixed bias state, regardless of whether the data voltage of the previous frame is a voltage for displaying a black picture or a white picture, the first transistor DTFT starts to write and compensate the data voltage from the fixed bias state, the data voltage of the display picture of the next frame is not affected by the data voltage of the display picture of the previous frame, the short-term afterimage problem caused by the hysteresis effect is greatly ameliorated, the display quality of the display panel is improved, and the user experience is effectively improved.

For example, the display panel 70 may be a rectangular panel, a circular panel, an oval panel, a polygonal panel, or the like. In addition, the display panel 70 may be not only a planar panel, but also a curved panel or even a spherical panel.

For example, the display panel 70 may also have a touch function, that is, the display panel 70 may be a touch display panel.

For example, the display panel 70 may be applied to any product or component having a display function, such as a mobile phone, a tablet computer, a television, a display, a notebook computer, a digital photo frame, a navigator, etc.

It should be noted that other components of the display panel 70 should be understood by those of ordinary skill in the art, and are not described in detail herein, nor should they be taken as limitations to the present disclosure.

In the description of the present disclosure, it is to be understood that the orientation or positional relationship indicated by the terms "center", "longitudinal", "transverse", "length", "width", "thickness", "on", "under", "front", "back", "left", "right", "vertical", "horizontal", "top", "bottom", "inner", "outer", "clockwise", "counterclockwise", "axial", "radial", "circumferential" and the like is based on the orientation or positional relationship shown in the drawings, is only for the convenience of describing the present disclosure and simplifying the description, and is not intended to indicate or imply that the referred devices or elements must have a specific orientation, be constructed and operated in a specific orientation, and therefore should not be construed as limiting the present disclosure.

Furthermore, the terms "first" and "second" are used for descriptive purposes only and cannot be understood as indicating or implying relative importance or implicitly indicating the amount of technical features indicated. Thus, features defined with terms "first" and "second" may explicitly or implicitly include at least one of the features. In the description of the present disclosure, the meaning of "plurality" is at least two, such as two, three, etc., unless otherwise specifically defined.

In the present disclosure, the terms "installation", "connected", "connection", "fixed", and the like should be understood in a broad sense unless otherwise expressly specified and defined, for example, may indicate a fixed connection, a removable connection, or being integrated; can also indicate a mechanical connection or an electrical connection. It can be directly connected or indirectly connected through an intermediate medium, and it can be the internal communication between two elements or the interaction relationship between two elements, unless otherwise explicitly defined. For those of ordinary skill in the art, the specific meanings of the above terms in the present disclosure can be understood according to specific situations.

In the present disclosure, unless otherwise explicitly specified and defined, a first feature being "on" or "under" on a second feature may indicate that the first feature and the second feature are in direct contact, or the first feature and the second feature are in indirect contact through an intermediate medium. Moreover, the first feature being "above", "over", and "on" the second feature may indicate that the first feature is directly above or obliquely above the second feature, or simply indicate that a horizontal height of the first feature is higher than a horizontal height of the second feature. The first feature being "below", "under", and "underside" the second feature may indicate that the first feature is directly or obliquely below the second feature, or simply means that a horizontal height of the first feature is lower than a horizontal height of the second feature.

In the description of this specification, the description with reference to the terms "an embodiment," "some embodiments," "examples," "specific examples," or "some examples", and the like means that a specific feature, structure, material, or characteristic described in connection with the embodiment or example are included in at least one embodiment or example of the present disclosure. In this specification, the schematic representation of the above-mentioned terms does not necessarily refer to the same embodiment or example. Moreover, the specific features, structures, materials, or characteristics described may be combined in a suitable manner in any one or more embodiments or examples. In addition, those skilled in the art can combine different embodiments or examples described in this specification and features in the different embodiments or examples without contradicting each other.

Although the embodiments of the present disclosure have been shown and described above, it is to be understood that the above-mentioned embodiments are exemplary and should not be construed as limiting the present disclosure, and those of ordinary skill in the art may make changes, modifications, substitutions, and variations to the above-mentioned embodiments within the scope of the present disclosure.

What is claimed is:

1. A pixel driving circuit, comprising: a driving sub-circuit, a reset sub-circuit, a light-emitting control sub-circuit, and a first compensation sub-circuit, wherein the reset sub-circuit is connected to a first power supply input terminal, a first driving signal terminal, the light-emitting control sub-circuit, and a first electrode of a light-emitting element;

the light-emitting control sub-circuit is also connected to a second driving signal terminal, a second terminal of the driving sub-circuit, and the first electrode of the light-emitting element;

the first compensation sub-circuit is connected to the first driving signal terminal, the second terminal of the driving sub-circuit, and a control terminal of the driving sub-circuit;

a first terminal of the driving sub-circuit is connected to a second power supply input terminal to receive a second power supply voltage;

the reset sub-circuit, the light-emitting control sub-circuit, and the first compensation sub-circuit are configured to, in an initialization phase, under control of a first driving signal provided by the first driving signal terminal and a second driving signal provided by the second driving signal terminal, provide a first power supply voltage provided by the first power supply input terminal to the control terminal of the driving sub-circuit; and the first power supply voltage and the second power supply voltage are configured to cause the driving sub-circuit to be in an on-bias state in the initialization phase;

the pixel driving circuit further comprises a data writing sub-circuit, a storage sub-circuit, and a second compensation sub-circuit, wherein the data writing sub-circuit is connected to a third driving signal terminal, a data signal terminal, and a first terminal of the storage sub-circuit, respectively, and is configured to, in the initialization phase, under control of a third driving signal provided by the third driving signal terminal, write a data voltage provided by the data signal terminal to the first terminal of the storage sub-circuit; and a second terminal of the storage sub-circuit is connected to the control terminal of the driving sub-circuit, and the storage sub-circuit is configured to store the data voltage;

the second compensation sub-circuit is connected to the third driving signal terminal, the first terminal of the storage sub-circuit, and the second power supply input terminal, respectively, and is configured to, in a compensation phase, under control of the third driving signal, provide the second power supply voltage to the first terminal of the storage sub-circuit;

the first driving signal terminal and the third driving signal terminal are a same signal terminal, and the first driving signal is identical to the third driving signal.

2. The pixel driving circuit according to claim 1, wherein the reset sub-circuit is further configured to, in the initialization phase, under control of the first driving signal, provide the first power supply voltage to the first electrode of the light-emitting element to reset the first electrode of the light-emitting element.

3. The pixel driving circuit according to claim 1, wherein the driving sub-circuit comprises a first transistor, the control terminal of the driving sub-circuit is a gate electrode of the first transistor, the first terminal of the driving sub-circuit is a first electrode of the first transistor, and the second terminal of the driving sub-circuit is a second electrode of the first transistor.

4. The pixel driving circuit according to claim 3, wherein the reset sub-circuit comprises a second transistor, a gate electrode of the second transistor is connected to the first driving signal terminal, a first electrode of the second transistor is connected to the first power supply input terminal, and a second electrode of the second transistor is connected to the first electrode of the light-emitting element;

the first compensation sub-circuit comprises a third transistor, a gate electrode of the third transistor is connected to the first driving signal terminal, a first electrode of the third transistor is connected to the gate electrode of the first transistor, and a second electrode of the third transistor is connected to the second electrode of the first transistor; and the light-emitting control sub-circuit comprises a fourth transistor, a gate electrode of the fourth transistor is connected to the second driving signal terminal, a first electrode of the fourth transistor is connected to the second electrode of the first transistor, and a second electrode of the fourth transistor is connected to the first electrode of the light-emitting element.

5. The pixel driving circuit according to claim 4, wherein an electrical characteristic of the first transistor, an electrical characteristic of the second transistor, an electrical characteristic of the third transistor, and an electrical characteristic of the fourth transistor are all identical.

6. The pixel driving circuit according to claim 5, wherein the first transistor, the second transistor, the third transistor, and the fourth transistor are P-type thin film transistors.

7. The pixel driving circuit according to claim 3, wherein the storage sub-circuit comprises a capacitor, the first terminal of the storage sub-circuit comprises a first electrode of the capacitor, the second terminal of the storage sub-circuit comprises a second electrode of the capacitor, and the first electrode of the capacitor is connected to the gate electrode of the first transistor;

the data writing sub-circuit comprises a fifth transistor, a gate electrode of the fifth transistor is connected to the third driving signal terminal, a first electrode of the fifth transistor is connected to the data signal terminal, and a second electrode of the fifth transistor is connected to the second electrode of the capacitor; and the second compensation sub-circuit comprises a sixth transistor, a gate electrode of the sixth transistor is connected to the third driving signal terminal, a first electrode of the sixth transistor is connected to the second electrode of the fifth transistor, and a second electrode of the sixth transistor is connected to the first electrode of the first transistor.

8. The pixel driving circuit according to claim 7, wherein an electrical characteristic of the first transistor is identical to an electrical characteristic of the fifth transistor, and the electrical characteristic of the first transistor is opposite to an electrical characteristic of the sixth transistor.

9. The pixel driving circuit according to claim 7, wherein the fifth transistor is a P-type thin film transistor, and the sixth transistor is an N-type thin film transistor.

10. The pixel driving circuit according to claim 1, wherein the first power supply voltage is less than the second power supply voltage, and both the first power supply voltage and the second power supply voltage are DC voltages.

11. The pixel driving circuit according to claim 1, wherein a second electrode of the light-emitting element is connected to a third power supply input terminal, and the light-emitting element is an organic light-emitting diode.

12. The pixel driving circuit according to claim 1, further comprising a data writing sub-circuit, a storage sub-circuit, and a second compensation sub-circuit, wherein the driving sub-circuit comprises a first transistor, the control terminal of the driving sub-circuit is a gate electrode of the first transistor, the first terminal of the driving sub-circuit is a first electrode of the first transistor, and the second terminal of the driving sub-circuit is a second electrode of the first transistor;

the reset sub-circuit comprises a second transistor, a gate electrode of the second transistor is connected to the first driving signal terminal, a first electrode of the second transistor is connected to the first power supply input terminal, and a second electrode of the second transistor is connected to the first electrode of the light-emitting element;

the first compensation sub-circuit comprises a third transistor, a gate electrode of the third transistor is connected to the first driving signal terminal, a first electrode of the third transistor is connected to the gate electrode of the first transistor, and a second electrode of the third transistor is connected to the second electrode of the first transistor;

the light-emitting control sub-circuit comprises a fourth transistor, a gate electrode of the fourth transistor is connected to the second driving signal terminal, a first electrode of the fourth transistor is connected to the second electrode of the first transistor, and a second electrode of the fourth transistor is connected to the first electrode of the light-emitting element;

the storage sub-circuit comprises a capacitor, the first terminal of the storage sub-circuit comprises a first electrode of the capacitor, the second terminal of the storage sub-circuit comprises a second electrode of the capacitor, and the first electrode of the capacitor is connected to the gate electrode of the first transistor;

the data writing sub-circuit comprises a fifth transistor, a gate electrode of the fifth transistor is connected to the third driving signal terminal, a first electrode of the fifth transistor is connected to the data signal terminal, and a second electrode of the fifth transistor is connected to the second electrode of the capacitor; and the second compensation sub-circuit comprises a sixth transistor, a gate electrode of the sixth transistor is connected to the third driving signal terminal, a first electrode of the sixth transistor is connected to the second electrode of the fifth transistor, and a second electrode of the sixth transistor is connected to the first electrode of the first transistor.

13. A display panel, comprising a pixel driving circuit, wherein the pixel driving circuit comprises: a driving sub-circuit, a reset sub-circuit, a light-emitting control sub-circuit, a first compensation sub-circuit, a data writing sub-circuit, a storage sub-circuit, and a second compensation sub-circuit the reset sub-circuit is connected to a first power supply input terminal, a first driving signal terminal, the light-emitting control sub-circuit, and a first electrode of a light-emitting element;

the light-emitting control sub-circuit is also connected to a second driving signal terminal, a second terminal of the driving sub-circuit, and the first electrode of the light-emitting element;

the first compensation sub-circuit is connected to the first driving signal terminal, the second terminal of the driving sub-circuit, and a control terminal of the driving sub-circuit;

a first terminal of the driving sub-circuit is connected to a second power supply input terminal to receive a second power supply voltage;

the reset sub-circuit, the light-emitting control sub-circuit, and the first compensation sub-circuit are configured to, in an initialization phase, under control of a first driving signal provided by the first driving signal terminal and a second driving signal provided by the second driving signal terminal, provide a first power supply voltage provided by the first power supply input terminal to the control terminal of the driving sub-circuit; and the first power supply voltage and the second power supply voltage are configured to cause the driving sub-circuit to be in an on-bias state in the initialization phase;

the data writing sub-circuit is connected to a third driving signal terminal, a data signal terminal, and a first terminal of the storage sub-circuit, respectively, and is configured to, in the initialization phase, under control of a third driving signal provided by the third driving signal terminal, write a data voltage provided by the data signal terminal to the first terminal of the storage sub-circuit; and a second terminal of the storage sub-circuit is connected to the control terminal of the driving sub-circuit, and the storage sub-circuit is configured to store the data voltage;

the second compensation sub-circuit is connected to the third driving signal terminal, the first terminal of the storage sub-circuit, and the second power supply input terminal, respectively, and is configured to, in a compensation phase, under control of the third driving signal, provide the second power supply voltage to the first terminal of the storage sub-circuit;

the first driving signal terminal and the third driving signal terminal are a same signal terminal, and the first driving signal is identical to the third driving signal.

14. A driving method for driving a pixel driving circuit, wherein the pixel driving circuit comprises: a driving sub-circuit, a reset sub-circuit, a light-emitting control sub-circuit, a first compensation sub-circuit, a data writing sub-circuit, a storage sub-circuit, a second compensation sub-circuit the reset sub-circuit is connected to a first power supply input terminal, a first driving signal terminal, the light-emitting control sub-circuit, and a first electrode of a light-emitting element;

the light-emitting control sub-circuit is also connected to a second driving signal terminal, a second terminal of the driving sub-circuit, and the first electrode of the light-emitting element;

the first compensation sub-circuit is connected to the first driving signal terminal, the second terminal of the driving sub-circuit, and a control terminal of the driving sub-circuit;

a first terminal of the driving sub-circuit is connected to a second power supply input terminal to receive a second power supply voltage;

the reset sub-circuit, the light-emitting control sub-circuit, and the first compensation sub-circuit are configured to, in an initialization phase, under control of a first driving signal provided by the first driving signal terminal and a second driving signal provided by the second driving signal terminal, provide a first power supply voltage provided by the first power supply input terminal to the control terminal of the driving sub-circuit; and the first power supply voltage and the second power supply voltage are configured to cause the driving sub-circuit to be in an on-bias state in the initialization phase, the data writing sub-circuit is connected to a third driving signal terminal, a data signal terminal, and a first terminal of the storage sub-circuit, respectively, and is configured to, in the initialization phase, under control of a third driving signal provided by the third driving signal terminal, write a data voltage provided by the data signal terminal to the first terminal of the storage sub-circuit; and a second terminal of the storage sub-circuit is connected to the control terminal of the driving sub-circuit, and the storage sub-circuit is configured to store the data voltage;

the second compensation sub-circuit is connected to the third driving signal terminal, the first terminal of the storage sub-circuit, and the second power supply input terminal, respectively, and is configured to, in a compensation phase, under control of the third driving signal, provide the second power supply voltage to the first terminal of the storage sub-circuit;

the first driving signal terminal and the third driving signal terminal are a same signal terminal, and the first driving signal is identical to the third driving signal;

the driving method comprises:

in the initialization phase, providing the second power supply voltage to the first terminal of the driving sub-circuit, and providing, through the reset sub-circuit, the light-emitting control sub-circuit, and the first compensation sub-circuit, the first power supply voltage to the control terminal of the driving sub-circuit to cause the driving sub-circuit to be in an on-bias state;

in a compensation phase, compensating a threshold voltage of the driving sub-circuit; and in a light-emitting phase, driving the light-emitting element to emit light.

15. The driving method according to claim 14, further comprising:

in the initialization phase, providing the first power supply voltage to the first electrode of the light-emitting element to reset the light-emitting element.

16. The driving method according to claim 14, wherein the first driving signal is at a first level in the initialization phase, and the second driving signal is at the first level in the initialization phase.

17. The driving method according to claim 16, wherein the first driving signal is at the first level in the compensation phase, the second driving signal is at a second level in the compensation phase, the first driving signal is at the second level in the light-emitting phase, and the second driving signal is at the first level in the light-emitting phase; and the second level is opposite to the first level, and in terms of timing sequence, the compensation phase is after the initialization phase and the light-emitting phase is after the compensation phase.

* * * * *